United States Patent [19]

Win

[11] Patent Number: 4,509,432

[45] Date of Patent: Apr. 9, 1985

[54] BLOCK AND STRINGER TYPE LIFT TRUCK PALLET

[75] Inventor: Michael M. Win, Fairport, N.Y.

[73] Assignee: Mobil Oil Corporation, New York, N.Y.

[21] Appl. No.: 484,797

[22] Filed: Apr. 14, 1983

[51] Int. Cl.[3] ..... B65D 19/00

[52] U.S. Cl. ..... 108/51.1; 108/52.1; 108/56.1; 108/901

[58] Field of Search ..... 108/51.1, 52.1, 901, 108/56.1, 53.1, 55.1, 57.1; 206/386, 597

[56] References Cited

U.S. PATENT DOCUMENTS

| | | | |
|---|---|---|---|
| T886,012 | 5/1971 | Small | 108/51.1 |
| 3,986,611 | 10/1976 | Dreher | 206/597 |

FOREIGN PATENT DOCUMENTS

| | | | |
|---|---|---|---|
| 264373 | 11/1967 | Austria | 108/51.1 |
| 1015218 | 10/1952 | France | 108/51.1 |

*Primary Examiner*—Francis K. Zugel
*Assistant Examiner*—Mark W. Binder
*Attorney, Agent, or Firm*—Alexander J. McKillop; Michael G. Gilman; James P. O'Sullivan, Sr

[57] ABSTRACT

Fork lift truck pallet having a load deck of a plastic stretch wrap film wrapped with tension about a pallet frame.

9 Claims, 4 Drawing Figures

BLOCK AND STRINGER TYPE LIFT TRUCK PALLET

BACKGROUND OF THE INVENTION

This invention relates to lift truck pallets.

Conventional wooden pallets comprise a lumber deck nailed to two by four stringers. Such pallets are expensive, heavy in weight and quite fragile.

It is an object of the invention to provide an inexpensive, easily constructed, light-weight, reuseable, reconstructable, shipping pallet.

It also is an object of the present invention to provide a process for forming such a pallet.

SUMMARY OF THE INVENTION

The present invention relates to a lift truck pallet comprising:

(a) a plurality of elongated narrow stringers arranged in parallel, spaced relation;

(b) a plurality of elongated narrow runners arranged in parallel, spaced relation, substantially at right angeles to said stringers;

(c) a plurality of space means in association with said runners at spaced intervals and defining, with said runners, lift truck fork openings in the sides of the pallet;

(d) the stringers and runners, being in lapped relation to each other;

(e) at each point of said lapping, a fastening means securing the lapped stringers and runners together;

(f) the stringers and runners forming the perimeter of a plurality of comparatively broad rectangles; and (g) one or more layers of plastic film covering said broad rectangles.

The present invention also relates to a process for forming the above-described pallet which process generally comprises assembling the runners, stringers and associated spacer means as defined and securing the same together by some fastening means and thereafter covering the broad rectangles, defined by the runners and stringers, with one or more sheets of plastic film so as to yield taut plastic product-supporting surfaces within the frame of said pallet.

DETAILED DESCRIPTION OF THE INVENTION

The manner of accomplishing the foregoing and other objects of this invention will be apparent from the accompanying specification and claims together with the drawings, wherein:

Figure 1:
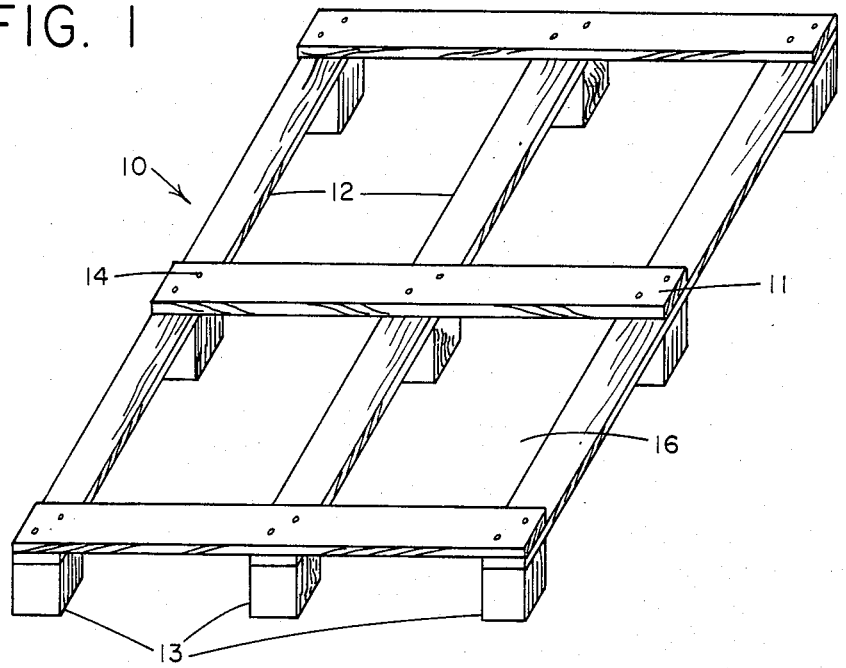
FIG. 1 is a perspective view of a pallet frame 10.
Figure 2:
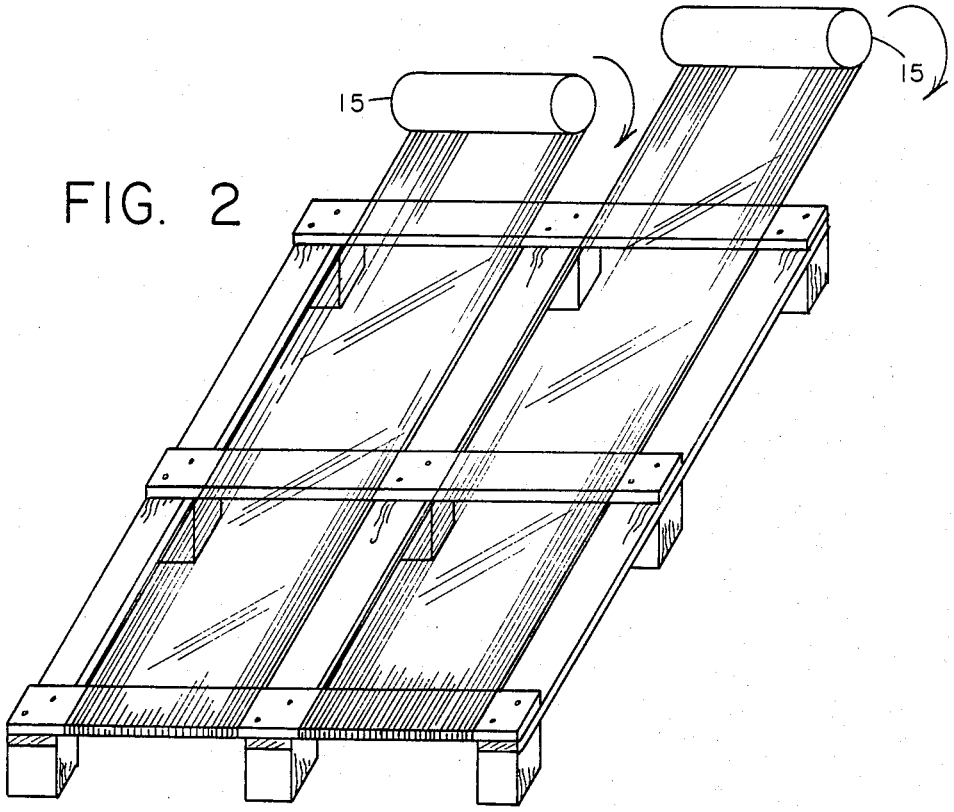
FIG. 2 is a perspective view depicting a manner of forming plastic surfaces over the rectangular openings of the pallet frame depicted in FIG. 1.
Figure 3:
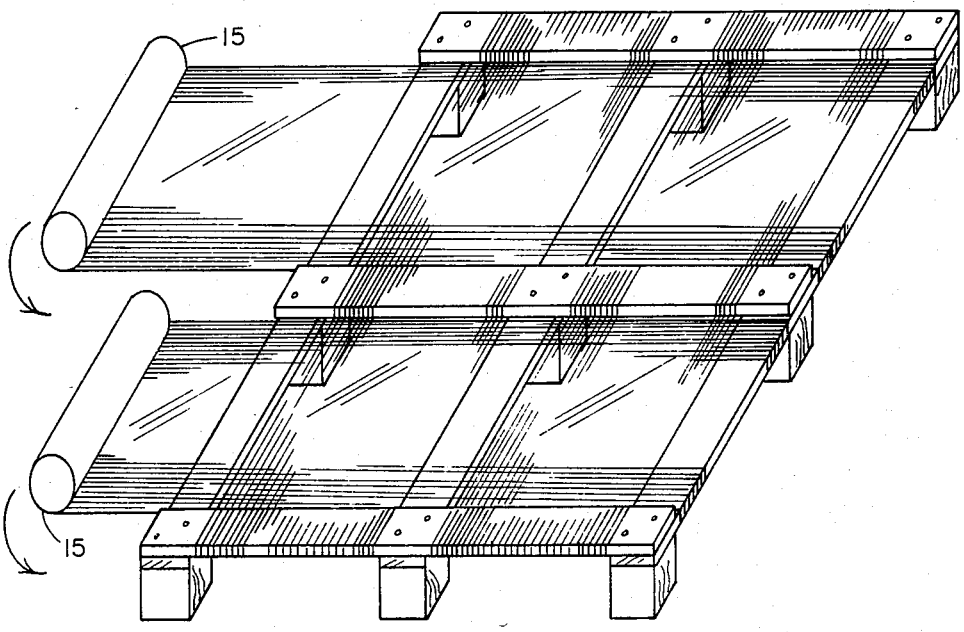
FIG. 3 is a perspective view depicting a manner of cross-covering the plastic surfaces of the structure of FIG. 3.
Figure 4:
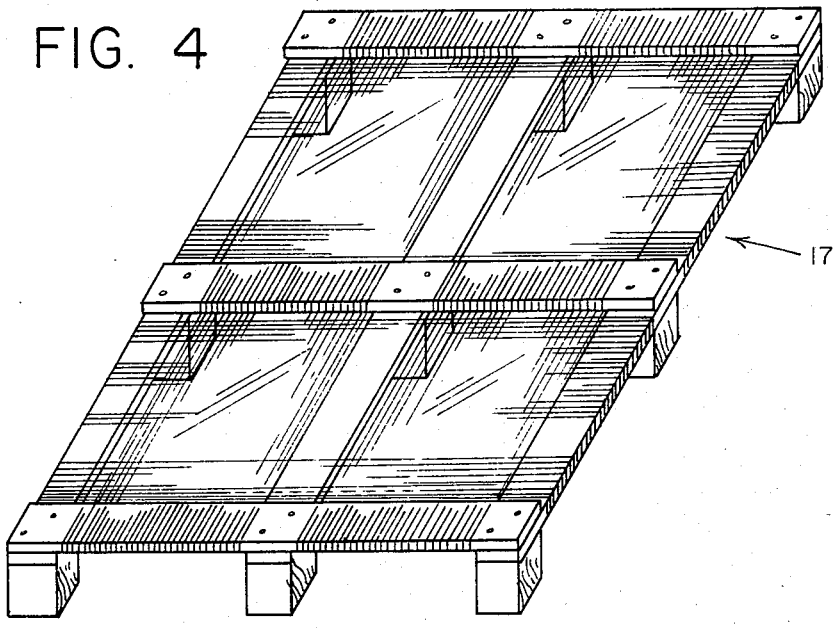
FIG. 4 depicts a completed pallet 17 having a plurality of plastic film support surfaces.

In the form of the invention illustrated by way of example in FIGS. 1–4, the pallet of the invention includes, with reference to FIG. 1, a representative entire pallet frame 10 composed of stringers 11, runners 12, spacer blocks 13 and rectangular openings 16. The stringers, runners and spacer blocks can be of any material, for example, metal, wood, plastic or any combination thereof. The cross-sectional shape of each member likewise is not material and can be square, rectangular, tubular, etc. The spacer blocks or means can be an integral part of the runners, e.g. a 2×4 sawed so as to have two or more spacer legs to accommodate the tines of the fork of a lift truck. The stringers, runners and spacer blocks can be fastened together by a fastening means 14. This fastening means can be of any type, for example, nails or bolts or screws or clamps, etc. FIG. 2 shows stretch wrap plastic film 15 being wrapped tightly about open rectangular areas 16. FIG. 3 shows stretch wrap plastic film 15 being cross-wrapped over the film of FIG. 2 to yield the completed pallet 17 which has a plurality of plastic film support surfaces at right angles to one another.

By the above described structure an inexpensive, easily constructed, shipping pallet having novel stretch wrap plastic support surfaces is provided. While the pallet frame can be constructed of any material, an inexpensive hardwood frame is preferred. The support surface can be provided by any polymer film but particularly preferred is a polyolefin stretch wrap film. Particularly preferred is a polyethylene stretch wrap film. The term polyethylene is employed in a somewhat generic sense in order to embrace not only polyethylene, such as low density polyethylene, but also high density polyethylene, linear low density polyethylene copolymerized with a low molecular weight alpha-olefin, blends of polyethylene with other polyolefins, etc. Any commercially available stretch wrap film can be employed in constructing the pallet of the present invention. Other films which can be employed include polyesters, polyamides, etc. The film can be of any thickness but preferably is in the range of about 0.1 to about 4 mils, particularly preferred is a thickness of from about 0.7 to about 1.35 mils. The rectangular spaces of the pallet frame can be overlaid with film in any convenient pattern, e.g. each at right angles to the other film layer or any variation thereof. In addition, the layers can be any number which is suitable for the load to be carried. For example, a polyolefin stretch wrap film can have five layers in one direction and five layers at right angles thereto. This can also include some diagonal change of direction layers when employing a single continuous film to apply the layers over and under the rectangular opening.

When the film layers become worn or torn through use, they can be removed and the pallet frame recovered with new film at little expense.

The term rectangles as used herein is generic to a square. The stretch wrap polyolefin film preferred herein is a product commercially available from Mobil Oil Corporation, Macedon, N.Y. It should be applied to the constructed frame under braking tension so as to stretch the film and while stretched, it should be affixed to the frame. With five 0.9 mil stretch film layers in one direction and five 0.9 mil stretch film layers 90° thereto, all being under reasonable tension such a pallet has been shown to easily and indefinitely carry a ton of standard cinder blocks.

What is claimed is:

1. A lift truck pallet comprising in combination:

(a) a plurality of elongated narrow stringers arranged in parallel, spaced relationship;

(b) a plurality of elongated narrow runners arranged in parallel, spaced relation, substantially at right angles to the stringers so as to form the perimeter of a plurality of comparatively broad open spaces;

(c) spacer means defining lift truck fork openings in the sides of the pallet;

(d) fastening means securing the stringers and runners together; and (e) said broad open spaces being tautly overwrapped with a plurality of layers of stretch wrap film in its tension-stretched condition, so as to form in cooperation with said stringers and runners, plastic film product-supporting surfaces for said open spaces of said pallet.

2. The pallet of claim 1 wherein said layers are cross-wrapped to yield a pallet having a plurality of plastic film product-supporting surfaces at right angles to one another.

3. The pallet of claim 1 wherein the several layers of film are continuous and include some diagonal change-of-direction layers.

4. The pallet of claim 1 wherein two or more layers cover said open spaces.

5. The pallet of claim 4 wherein said open spaces are rectangular in shape.

6. The pallet of claim 4 wherein said plastic film layer is continuous from one rectangle to the next to be covered.

7. A process for preparing a lift truck pallet comprising:

(a) arranging a plurality of elongated narrow stringers in parallel, spaced relation;

(b) arranging a plurality of elongated narrow runners in parallel, spaced relation substantially at right angles to said stringers so as to form the perimeter of a plurality of comparatively broad rectangles;

(c) providing spacer means defining lift truck fork openings in the sides of the pallet;

(d) fastening said stringers and runners together; and (e) tautly overwrapping said plurality of comparatively broad open spaces framed by said stringers and runners with a plurality of layers of stretch wrap film by applying braking tension to said film so as to stretch the film and while stretched affixing it to the structure.

8. The process of claim 7 wherein said overwrapping includes some cross overwrapping.

9. The process of claim 7 wherein said stretch wrap film is a polyolefin film.

* * * * *